US005611447A

United States Patent [19]

Tye

[11] Patent Number: 5,611,447

[45] Date of Patent: Mar. 18, 1997

[54] CONTAINER FOR MATERIALS USED WITH A CHARCOAL DEPENDENT COOKER

[76] Inventor: William G. Tye, 23 Sunset St., Satellite Beach, Fla. 32937

[21] Appl. No.: 358,960

[22] Filed: Dec. 19, 1994

[51] Int. Cl.[6] ..... B65D 88/00

[52] U.S. Cl. ..... 220/2; 220/503; 206/96

[58] Field of Search ..... 220/2, 503, 524, 220/906; 206/96

[56] References Cited

U.S. PATENT DOCUMENTS

| | | | |
|---|---|---|---|
| 154,817 | 9/1874 | Wright | 220/2 |
| 224,490 | 2/1880 | Sturges | 220/503 X |
| 366,393 | 7/1887 | Hager | 220/2 X |
| 444,076 | 1/1891 | Smith | 220/2 X |
| 654,823 | 7/1900 | Beritzhoff | 220/2 X |
| 885,094 | 4/1908 | Soderblom | 220/2 |
| 1,049,148 | 12/1912 | Rhoades | 206/96 |
| 4,128,170 | 12/1978 | Elliott | 220/503 X |
| 4,287,874 | 9/1981 | Michael | 220/2 X |

*Primary Examiner*—Steven M. Pollard
*Attorney, Agent, or Firm*—Maguire, Voorhis & Wells, P.A.; Robert L. Wolter

[57] ABSTRACT

A reusable molded plastic container, FIG. 2, which is conveniently shaped for storage and transportation of materials used with a charcoal dependent cooker such as a barbecue, smoker or grill. The container has cover 17*f*, 17*b* and 25 which open and close and protect its contents from external elements such as moisture. It also has a handle 20 for carrying and holding while pouring the contents, along with the rear leg 31*b* which is shaped for gripping while pouring. The container has multiple compartments for containing materials used with out door cooking and these compartments are conformed to resist external elements which may effect the usefulness of the contents. This container is also fitted with latch/lock mechanisms 16*f*-15*f*, 16*b*-15*b*, 29-26, which hold the covers closed and can be locked by the user if chosen. It has various compartments which are more suitable for particular items, such as the main compartment 39 is more suitable for charcoal briquettes and the rear compartment 35 is more suitable for a lighter fluid container because of its reservoir 40 which can maintain leaks or spills. While the top rear compartment 33 is more suitable for matches, lighters and hot pads or cooking gloves and the bottom compartment 38 is more suitable for cooking utensils such as elongated spatulas, cooking forks and tongs

1 Claim, 3 Drawing Sheets

CONTAINER FOR MATERIALS USED WITH A CHARCOAL DEPENDENT COOKER

FIELD OF THE INVENTION

This invention relates to the transportation and storage of materials used with a charcoal dependent cooker, such as a barbecue, smoker or grill.

BACKGROUND OF THE INVENTION

The materials used to start, produce and manage a charcoal dependent cooker (grill, barbecue, smoker, etc.) are commercially supplied separately and this philosophy is maintained by the consumer in their transportation and storage. Such items as charcoal briquettes, lighter fluid, matches, lighters, cooking gloves, cooking utensils, etc., are individually packaged for point of sale purposes only.

Although the manufacturer's of these items may consider this sufficient, there is no consideration for their transportation or storage as a collective group. Nor is there any consideration for consumer convenience or the conditions that these items are exposed to such as container damage, weather and child safety. Any major damage to the charcoal briquette or match container, although the contents may still be reusable, forces the consumer to find a substitute container.

Taking a brief look at the materials, herewithin stated, we as consumers can see the short falls of the existing packaging methods during consumption.

Charcoal briquettes are packaged in paper bags which have no resistance to moisture (rain) or tearing, and are not easily cleaned (charcoal dust and dirt) for transportation or storage.

Matches are packaged in paper or cardboard containers that are easily accessible or opened by children and these containers are very susceptible to moisture.

Lighter fluid is packaged in a container with a pop open top and this container is easily accessible or opened by children and may leak or spill during transportation or storage.

Lighters or mechanical lighting apparatuses are easily accessible and operated by children and can also be affected by the weather.

Cooking gloves and cooking utensils are packaged in various ways for point of sale purposes only.

SUMMARY OF THE INVENTION

The present invention provides a reusable storage and transportation container which is more suitable for the consumer during the consumption of materials used with a charcoal dependent cooker. Furthermore, this invention provides a container that is easy to carry, store and utilize, while also providing additional protection from the elements as well as optional safety features.

Although the shape, size, color, combination of features and material used in manufacturing this container may vary, it is the object of this invention to provide a container which is durable for the aforementioned application, while convenient and safe for the consumer.

In keeping with the principle of the invention, the foregoing object of this invention is to provide the consumer with an alternative container, which more closely meets their needs and desires during consumption of the aforementioned materials. These needs and desires can be fulfilled with various features, or combination of features, of the novelty that characterizes the invention, and are pointed out with particularity in the claims and drawings annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

BRIEF DESCRIPTION OF THE DRAWINGS

In the drawings, closely related figures have the same number but different alphabetic suffixes.

REFERENCE NUMERALS IN DRAWINGS

Figure 1:
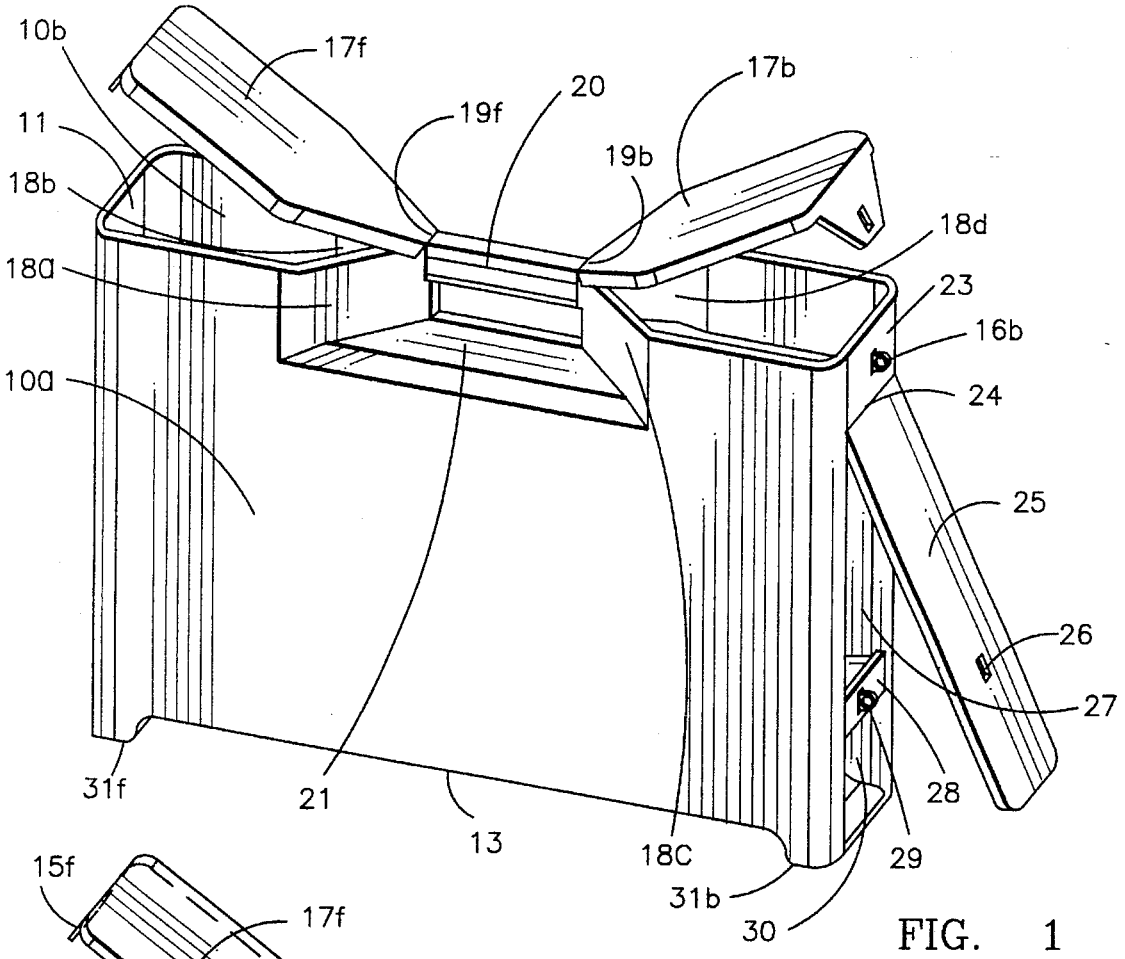
FIG. 1 shows a perspective upright view of the container's exterior only with compartment covers open.

| | |
|---|---|
| 10a, b | side wall |
| 11 | front wall |
| 13 | bottom wall |
| 14f, b | cover flap |
| 15f, b | latch/lock opening |
| 16f, b | latch/lock |
| 17f, b | compartment cover |
| 18a,b,c,d | upper wall |
| 19a, b | hinge |
| 20 | carrying handle |
| 21 | top wall |
| 23 | rear wall |
| 24 | hinge |
| 25 | rear cover |
| 26 | latch/lock opening |
| 28 | reservoir wall |
| 29 | latch/lock |
| 31f, b | leg |
| 32 | partition |
| 33 | top compartment |
| 34 | partition |
| 35 | rear compartment |
| 36 | partition |
| 37 | partition |
| 38 | bottom compartment |
| 39 | main compartment |
| 40 | reservoir |
| 41a,b,c,d | contoured edge |

DETAILED DESCRIPTION OF THE INVENTION

Referring to the drawings, there is illustrated a molded plastic, synthetic plastic or rubber container with multiple features that portray the embodiment of this invention. The main exterior of this symmetric container in FIG. 1 consists of side wall 10*a* and 10*b*, connected to a front wall 11, a bottom wall 13, a top wall 21, a rear wall 23, and a rear cover 25 which is connected by a hinge 24 to rear wall 23. Along the top exterior of the container are a compartment cover 17*f* and 17*b* which are shown in an open position and are connected by a hinge 19*f* and 19*b* respectively to a carrying handle 20. Also along this top exterior are upper wall 18*a*, 18*b*, 18*c* and 18*d* that are connected together in pairs and connected to side wall 10*a* and 10*b*, top wall 21 and carrying handle 20.

The back of the container shown in FIG. 1, consists of rear wall 23 a latch/lock 16*b*, hinge 24 and rear cover 25 which contains a latch/lock opening 26. Also at the rear of the container is a reservoir wall 28 which is connected to side wall 10*a* and 10*b* and consists of a latch/lock 29.

The bottom of the container in FIG. 1, has bottom wall 13 which is connected to the bottom of side wall 10*a*, 10*b* and the bottom of front wall 11. The union of these walls as well as their particular shape form a leg 31*f* and 31*b*.

Figure 3:
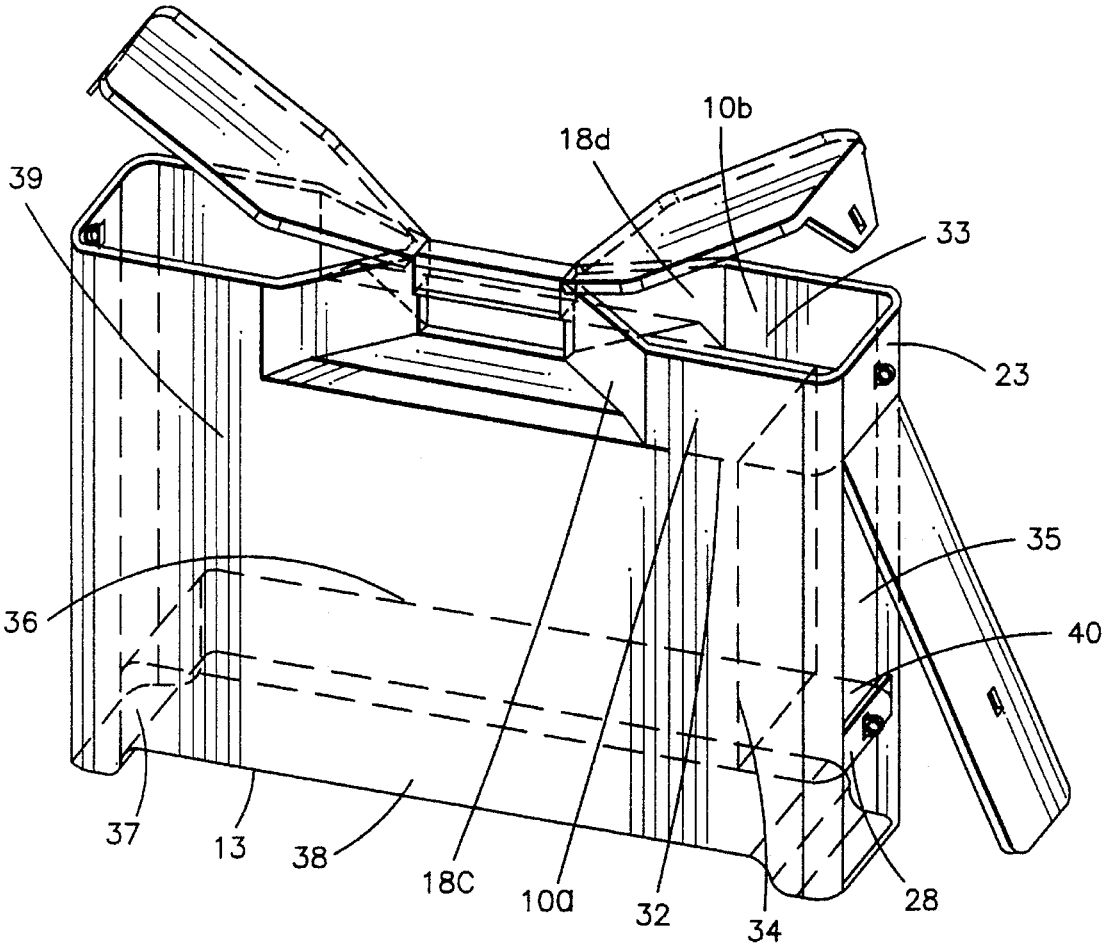
FIG. 3 is a view of the container of FIG. 1 showing the container's internal structure.

The interior of the container as shown in FIG. 3 consists of a main compartment 39, a top compartment 33, a rear compartment 35 and a bottom compartment 38. The top compartment 33 is separated from main compartment 39 and rear compartment 35 by a partition 32 which is connected horizontally to the bottom of upper wall 18*c* and 18*d*, to side wall 10*a* and 10*b*, and to the bottom of rear wall 23. Rear compartment 35 is separated from main compartment 39 and bottom compartment 38 by a partition 34 which is connected vertically to side wall 10*a* and 10*b*, to the bottom of partition 32, and to the top side of a partition 36. Bottom compartment 38 is separated from main compartment 39 by partition 36 which is connected horizontally to side wall 10*a* and 10*b*, partition 36 extends from the bottom of reservoir wall 28 to a partition 37 which is connected to partition 36 and bottom wall 13.

As shown in FIG. 3 the union of partition 34, partition 36, reservoir wall 28 and side wall 10*a* and 10*b* create a reservoir 40.

Figure 4:
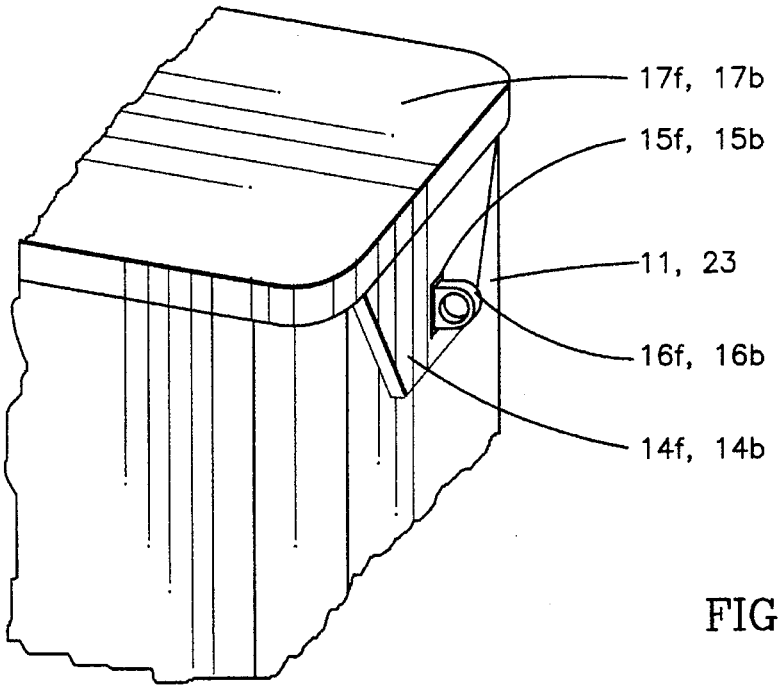
FIG. 4 is an enlarged sectional view of the latch/lock 16*f*, 16*b* and the respective latch/lock opening 15*f*, 15*b* in a closed position.

In an enlarged sectional view, FIG. 4, representing the compartment cover 17*f* and 17*b* in a closed position, shows they consist of a cover flap 14*f* and 14*b* with latch/lock opening 15*f* and 15*b* respectively. When compartment cover 17*f* and 17*b* are closed, cover flap 14*f* and 14*b* curve over the contour of the top of front wall 11 and the top of rear wall 23 respectively. In this closed position, latch/lock opening 15*f* and 15*b* slide over latch/lock 16*f* and 16*b* respectively, creating closed and latched covers with the option of being locked.

Figure 5:
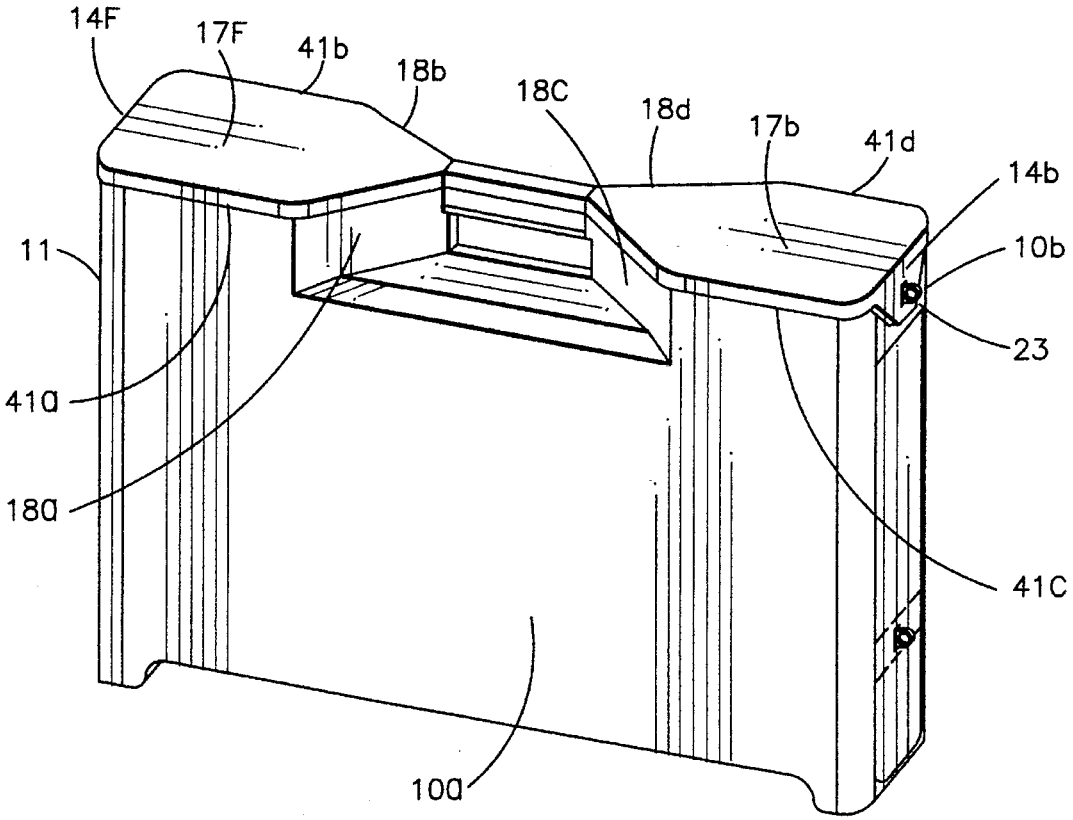
FIG. 5 shows an exterior only view of the container with all compartment covers closed.

The compartment cover 17*f* and 17*b*, FIG. 5, also consist of a contoured edge 41*a*, 41*b*, 41*c* and 41*d*. When compartment cover 17*f* and 17*b* are in a closed position, contoured edge 41*a*, 41*b*, 41*c*, and 41*d* fit over the top of side wall 10*a*, 10*b* and upper wall 18*a*, 18*b*, 18*c*, 18*d* respectively. This along with the combination of aforementioned cover flap 14*f*, 14*b* to front wall 11 and rear wall 23, create closures for the main compartment 39 and top compartment 33 shown only in FIG. 2 and 3.

Figure 6:
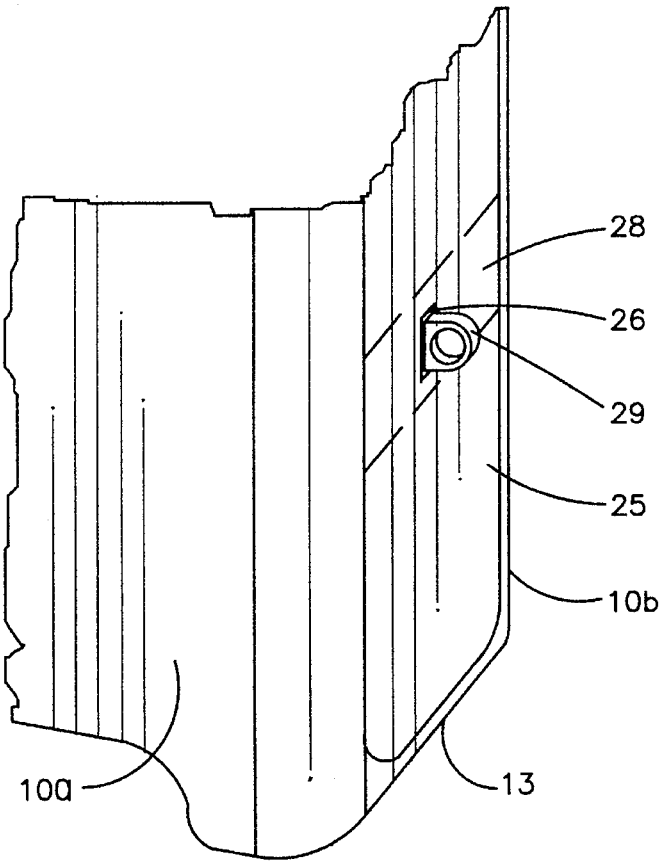
FIG. 6 is an enlarged sectional view of the latch/lock 29 and the respective latch/lock opening 26 in a closed position.

As illustrated in FIG. 6 when rear cover 25 is in a closed position it nests between side wall 10*a* and 10*b*, over reservoir wall 28 and meets with the end of bottom wall 13. In this closed position latch/lock opening 26 slides over latch/lock 29 creating a closed and latched cover with the option of being locked.

It is understood that the above described embodiment is merely illustrative of the application. Other embodiments may be readily devised by those skilled in the art which embody the principles of the invention and fall within the spirit and scope thereof. Therefore it is intended in the appended claims to cover all such equivalent variations that come within the scope of this invention.

OPERATION OF THE INVENTION

Figure 2:
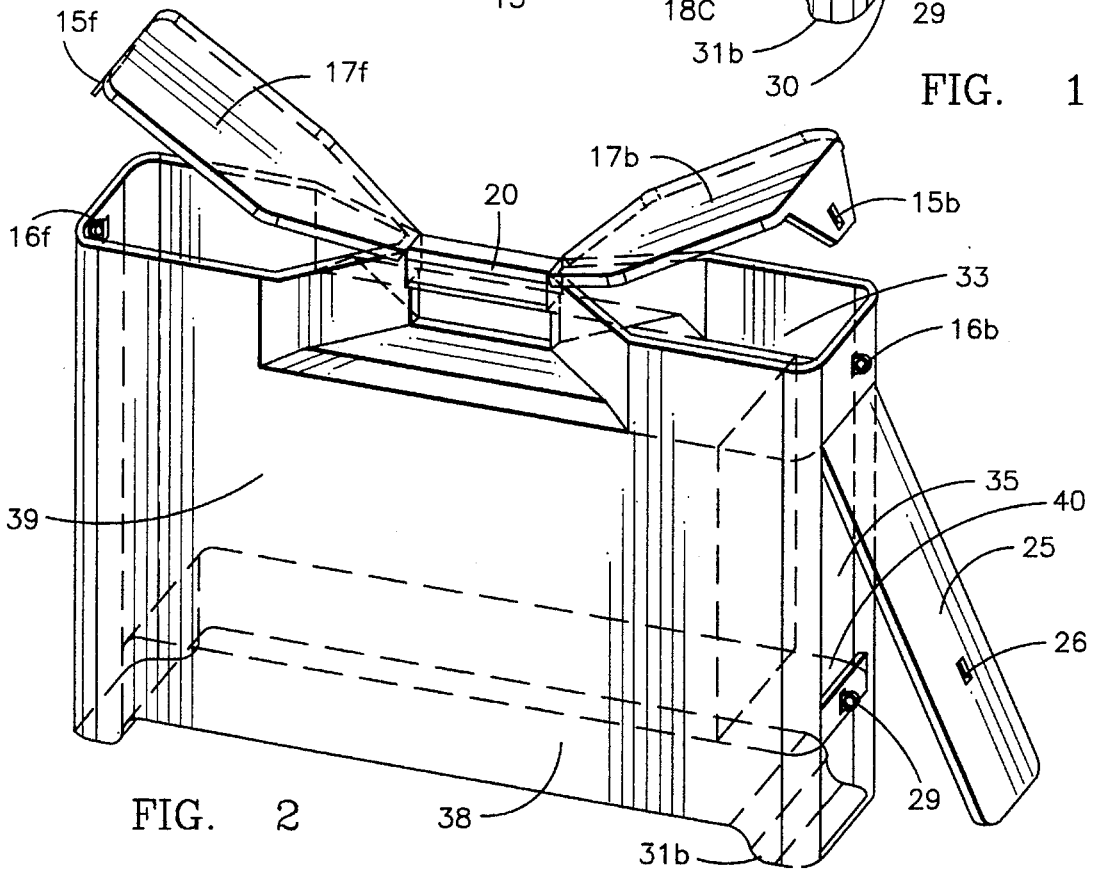
FIG. 2 is a view of the container of FIG. 1 showing the container's internal compartments as described in the abstract.

The main compartment 39, FIG. 2, may be accessed by lifting the compartment cover 17*f*, and in this preferred embodiment a user would pour the charcoal briquettes into this compartment for storage. Then by closing, FIG. 4, the compartment cover 17*f* the latch/lock opening 15*f* would slide over latch/lock 16*f* and hold the cover closed. At this time the user would have the option of locking this compartment with a small pad lock of their choice (pad lock not displayed on drawings).

In order for the user to access the charcoal briquettes they would lift up the bottom of cover flap 14*f*, pulling it away from the container until latch/lock opening 15*f* has cleared latch/lock 16*f* and then lifting compartment cover 17*f* open. Then by holding, FIG. 2, the carrying handle 20 with one hand and leg 31*b* with the other hand and tilting the container forward until the desired amount of charcoal briquettes is dispensed. If compartment cover 17*b* and rear cover 25 are closed, the contents of the other three compartments will stay intact during this procedure.

Compartment cover 17*b* can be opened, closed and optionally locked in the same manner as compartment cover 17*f*. In its closed position it will secure the contents of Top compartment 33. In this preferred embodiment the user has a choice of storing items such as cooking gloves, hot pads, matches and/or lighters in this area.

Much like the previously mentioned covers in their closed position, rear cover 25 with latch/lock opening 26 would slide over latch/lock 29 holding rear cover 25 closed. At this time the user would have the option of locking the access to rear compartment 35 and bottom compartment 38 with a small pad lock of their choice (pad lock not displayed on drawings).

In this preferred embodiment the user should store lighter fluid container in an up right position in rear compartment 35. This compartment contains reservoir 40 which would not only help hold the container up right but would also contain any minor spills or leaks.

Bottom compartment 38 is especially formed in order to store cooking utensils such as elongated spatulas, forks or thongs that are commonly used when cooking out. However, this compartment maybe optionally used to store an electric starter (in a cooled down condition) which is often used instead of lighter fluid.

The above operation description is only a suggested procedure for storing these materials and the option of compartment utilization is up to the user, as well as locking the compartments for safety.

With the covers closed and all of the materials required for cooking out inside the container, FIG. 5, a user can pickup the container by gripping carrying handle 20 and lifting. The container's shape and structure allow the container to be transported and stored where ever the user chooses, including their vehicle.

SUMMARY, RAMIFICATIONS, AND SCOPE

Accordingly the reader will see that this container provides the consumer with a convenient and more practical way of storing and transporting materials required for cooking out in that

* the materials required can be stored and transported together

* the materials have added protection from external elements

* the container has optional safety features

Although the description above contains a particular shape, combination of compartments and features, this should not be construed as limiting the scope of the invention but as merely providing illustrations of some of the presently preferred embodiments of this invention. For example, the container can have other shapes, such as cylindrical, trapezoidal, triangular, square, etc. The container may also be more upright in height then in length and consist of more or less compartments and may have different types of covers. The latch/lock features may vary dependent on consumer requirements and manufacturability.

Thus the scope of the invention should be determined by the appended claims and their legal equivalents, rather than by the examples given.

I claim:

1. A container for transportation and storage of charcoal and outdoor cooking materials, said container comprising:

a) a first side wall and a second side wall, a front wall intermediate an end of the first side wall and second side wall, a rear wall substantially parallel said front wall intermediate an opposite end of the first side wall and second side wall, a bottom wall attached to the side walls and front and rear walls forming a bottom of the container;

b) said first side wall, second side wall, front wall, and rear wall forming a first top opening and a second top opening lying in a single plane;

c) a top wall extending from said first side wall to said second side wall and intermediate said first and second top opening;

d) a handle mounted to the container adjacent said first top opening and said second top opening, said handle having parallel upper and lower surfaces extending parallel to said top opening plane, with said lower surface vertically spaced above the top wall to allow a users hand to grip around the handle;

e) a first partition, mounted in the container above, and substantially parallel the bottom of the container, forming a lower compartment and an upper main compartment with said first top opening in communication with the upper main compartment;

f) a second partition, mounted in the container toward the rear wall, and parallel to said rear wall, forming a side compartment adjacent the upper main compartment;

g) a door and latch means, mounted to said rear wall, for access to said side compartment and said lower compartment;

h) a third partition mounted in the container above and parallel the bottom partition, forming a top compartment in communication with the second top opening;

i) a first cover hingedly mounted over said first top opening and a second cover hingedly mounted over said second top opening; and j) a notch means formed in the bottom wall toward said rear wall for grasping the container and tilting the same to empty the contents from the main compartment.

* * * * *